US007212957B2

(12) United States Patent
Rau

(10) Patent No.: US 7,212,957 B2
(45) Date of Patent: May 1, 2007

(54) MODEL RAILROAD CONTROL AND DISPLAY SYSTEM

(75) Inventor: Clifton A. Rau, Sykesville, MD (US)

(73) Assignee: Ez Switch Corp., Quincy, PA (US)

( * ) Notice: Subject to any disclaimer, the term of this patent is extended or adjusted under 35 U.S.C. 154(b) by 1358 days.

(21) Appl. No.: 09/850,149

(22) Filed: May 8, 2001

(65) Prior Publication Data

US 2003/0167106 A1 Sep. 4, 2003

(51) Int. Cl.
*G06G 7/48* (2006.01)
*B81L 5/00* (2006.01)
*H02P 1/00* (2006.01)

(52) U.S. Cl. ..... 703/6; 246/219; 318/280

(58) Field of Classification Search ..... 703/6; 246/219; 318/280
See application file for complete search history.

(56) References Cited

U.S. PATENT DOCUMENTS 5,492,290 A * 2/1996 Quinn et al. ..... 246/219
6,270,040 B1 * 8/2001 Katzer ..... 246/1 R
6,445,150 B1 * 9/2002 Tanner et al. ..... 318/280

* cited by examiner

*Primary Examiner*—Hugh Jones
(74) *Attorney, Agent, or Firm*—Steven M. duBois

(57) ABSTRACT

A software tool and an electronic interface facilitate model railroaders in initiating, monitoring and directing the path trains (i.e. engine and rail cars) will traverse on the model layout. The software tool and an electronic interface are connected to one of the I/O ports of a computer. The display presented on the computer monitor will mimic the model railroad layout depicting each track turnout with a red or green path. The green path depicts the selected path through the turnout while the red path is the deselected path. With all turnouts displayed simultaneously the condition of the layout relative to train movement can be seen at once by following the green paths. To change the path through a turnout, the user places the cursor on the representation of the turnout on the computer display and performs a left mouse button click. The software will recognize the particular turnout selected and cause a momentary actuating signal to be sent to the tracks turnout motor through the electronic interface. The software will rewrite the red/green legs of the display to maintain the agreement of the display with the physical layout turnout.

7 Claims, 9 Drawing Sheets

MODEL RAILROAD CONTROL AND DISPLAY SYSTEM

BACKGROUND

The present invention relates generally to systems and methods for computer enhanced control and display of model railroad layouts and, more particularly, to the computer control of turnouts in model railroads.

Model railroads have been popular for many years. Even as actual passenger trains are fading in popularity and commercial viability, many model railroads have been created that are small-scale replicas of real-life passenger and freight trains.

Model railroad track and other accessories can be setup in numerous different patterns to create unique layouts for the hobbyist's enjoyment. A very simple example of a layout is provided as FIG. 1. Therein, it can be seen that the layout includes a number of sections of model railroad track. Some of the track sections, e.g., sections 10 and 12, are straight, some of the track sections, e.g., 14 and 16, are curved and still others, e.g., 18 and 19, are sections which are referred to herein as "turnouts". Turnouts are track elements that provide different, selectable paths through the layout. These turnouts come in two basic patterns, though additional variations exist, i e., left hand 19 and right hand 18 turnouts. In the context of track layouts, turnouts are points of interest that allow for servicing business and main line diversions. Thus most working layouts will have an abundance of these turnouts.

There are at least two popular motorized approaches for the remote control of turnouts. For example, the motors in the turnout may be either of the solenoid or rotational type. The solenoid motor configuration uses two solenoids to change the path. One solenoid activates the through path and the other solenoid activates the turnout path. Switching the solenoids requires a low voltage AC signal applied for a short duration This short duration is significant because most solenoid motors overheat and quickly self-destruct. The rotational motor is allowed to rotate until a mechanical limit is reached. This motor uses a polarized DC voltage to effect a path change, however, only one motor is required as compared with a turnout which uses a solenoid configuration. Moreover, when using the rotational motor, the applied voltage duration is not critical, and in fact it must remain applied to keep the motor at the desired limit.

Although they create an interesting and dynamic layout, an abundance of turnouts can also create challenges, however, as the hobbyist needs to create a reliable way to move trains through the maze of track and turnouts. Additionally, it is desirable to be able to rapidly and easily control the position of each turnout, i.e., to its through path or its turnout path. There have been many techniques used over the years to address this problem. One solution, for example, has been to provide a plywood panel with a series of push button switches placed on the board in some logical way so that the hobbyist, with practice, can associate each push button switch with a track turnout on the layout. Pushing the correct switch then adjusts the setting of the associated turnout.

To enhance the association between the push button switch on the plywood and the actual turnout that it controls, another prior art technique involves the creation of a presentation of the layout on the plywood panel, usually with lines formed from paint or colored tape. The push button switches can then be placed on the plywood at the point on the paint or taped layout which corresponds to the turnout positions on the physical layout. This scheme provides a visual queue depicting which push switch is correlated with each turnout in the layout. It does not, however, provide a visual queue of the current path through the other turnouts in the layout. Additionally, it does not provide an easy way to adapt to changes in the layout since such changes require adjustments both in that painted layout and the physical placement of the pushbutton switches.

Another consideration for the hobbyist is the dead spot in the turnout call a "frog". The frog is a short section of the turnout that is electrically isolated from the rest of the track to prevent short circuiting the track. Hobbyists like or need to power this section of track, the frog, because some engines jerk or monetarily slow down as they cross the unpowered frog.

SUMMARY

According to exemplary embodiments of the present invention, these and other drawbacks and difficulties of conventional railroading techniques are overcome according to the present invention. Thus, one objective of the present invention is to provide the model railroad hobbyist with a visual presentation of the current status of the turnouts in the layout, as well as providing a means to easily alter the paths through the track maze.

Another object of the present invention is to provide a practical method of creating a facsimile of the hobbyist's layout, to be presented on a computer monitor. Yet another object of the present invention is to provide an electrical interface between the computer, computer monitor, and the track turnout motors which aids in selectively changing the turnout positions.

Exemplary embodiments of the present invention also include software programs which provide for a graphical editor which is usable to generate encoded commands for altering the status of turnouts in a layout. Using the graphical editor, a hobbyist can make visual changes to the layout. These changes are then translated into encoded commands, which are output, e.g., to an I/O port on a personal computer and forwarded to a digitally controlled switching mechanism associated with the turnout whose functionality has been modified by the graphical editor.

BRIEF DESCRIPTION OF THE DRAWINGS

These and other objects, features and advantages of the present invention will be readily understood by those skilled in the art by reading the following detailed description in conjunction with the drawings, in which.

DETAILED DESCRIPTION

In the following description, for purposes of explanation and not limitation, specific details are set forth, such as particular systems, networks, software components, techniques, etc. in order to provide a thorough understanding of the present invention. However, it will be apparent to one skilled in the art that the present invention may be practiced in other embodiments that depart from these specific details. In other instances, detailed descriptions of well-known methods, devices, and circuits are omitted so as not to obscure the description of the present invention. S Ass will be appreciated by those skilled in the art, model railroading per se refers to a hobby wherein reduced scale replicas of different types of trains, tracks and accompanying structures are arranged in a layout and wherein the trains operate under electrical power. For purposes of example, model railroads include G, O, S, HO, N, and Z gauge scale railroads. Details of model railroads themselves are beyond the scope of the present description, however the interested reader is referred to *Practical Guide To HO Model Railroading* published by Kalmbach Publishing Co. (1999), the disclosure of which is incorporated here by reference.

Figure 1:
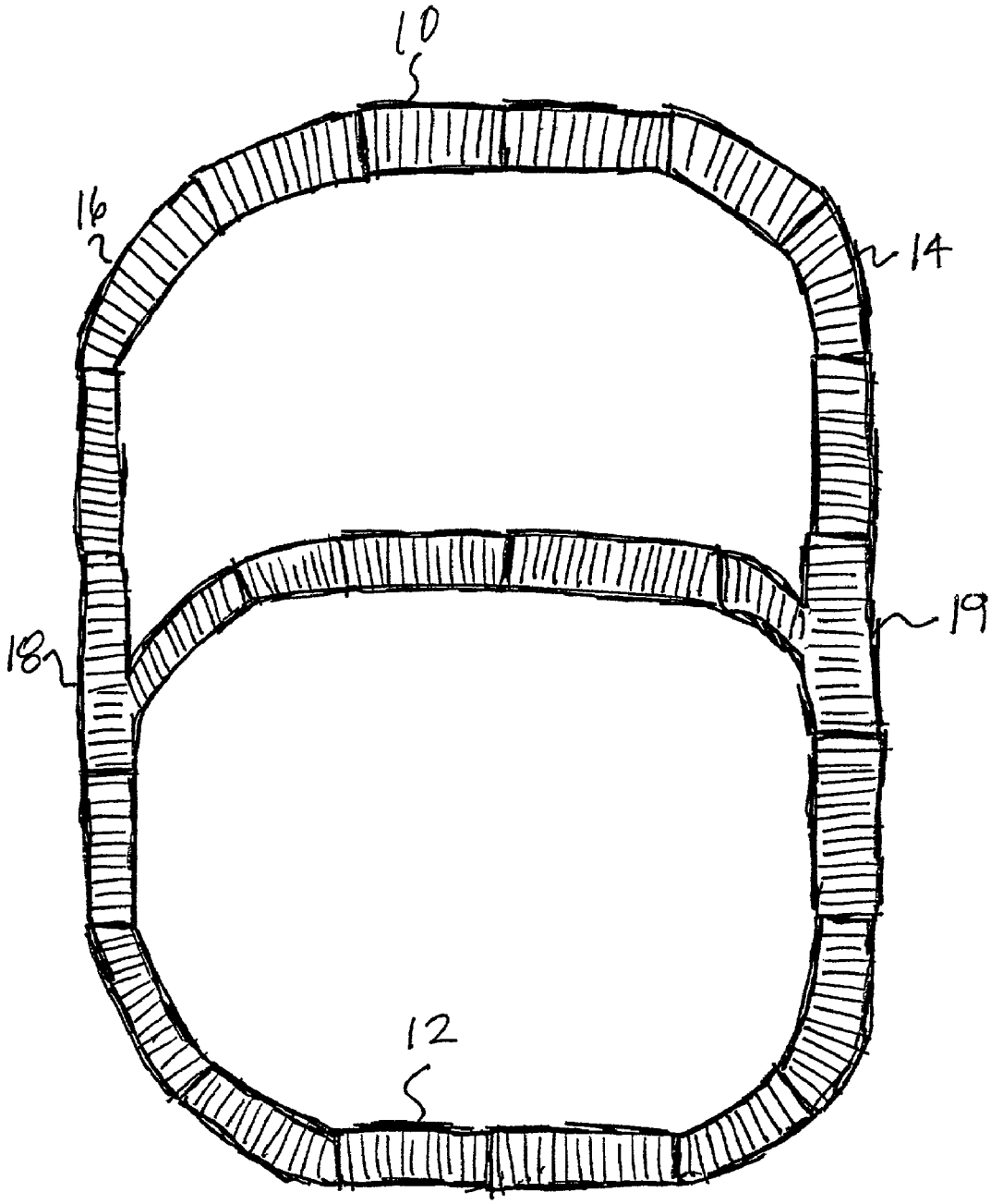
FIG. 1 depicts an exemplary model railroad track layout used to describe exemplary embodiments of the present invention.
Figure 2:
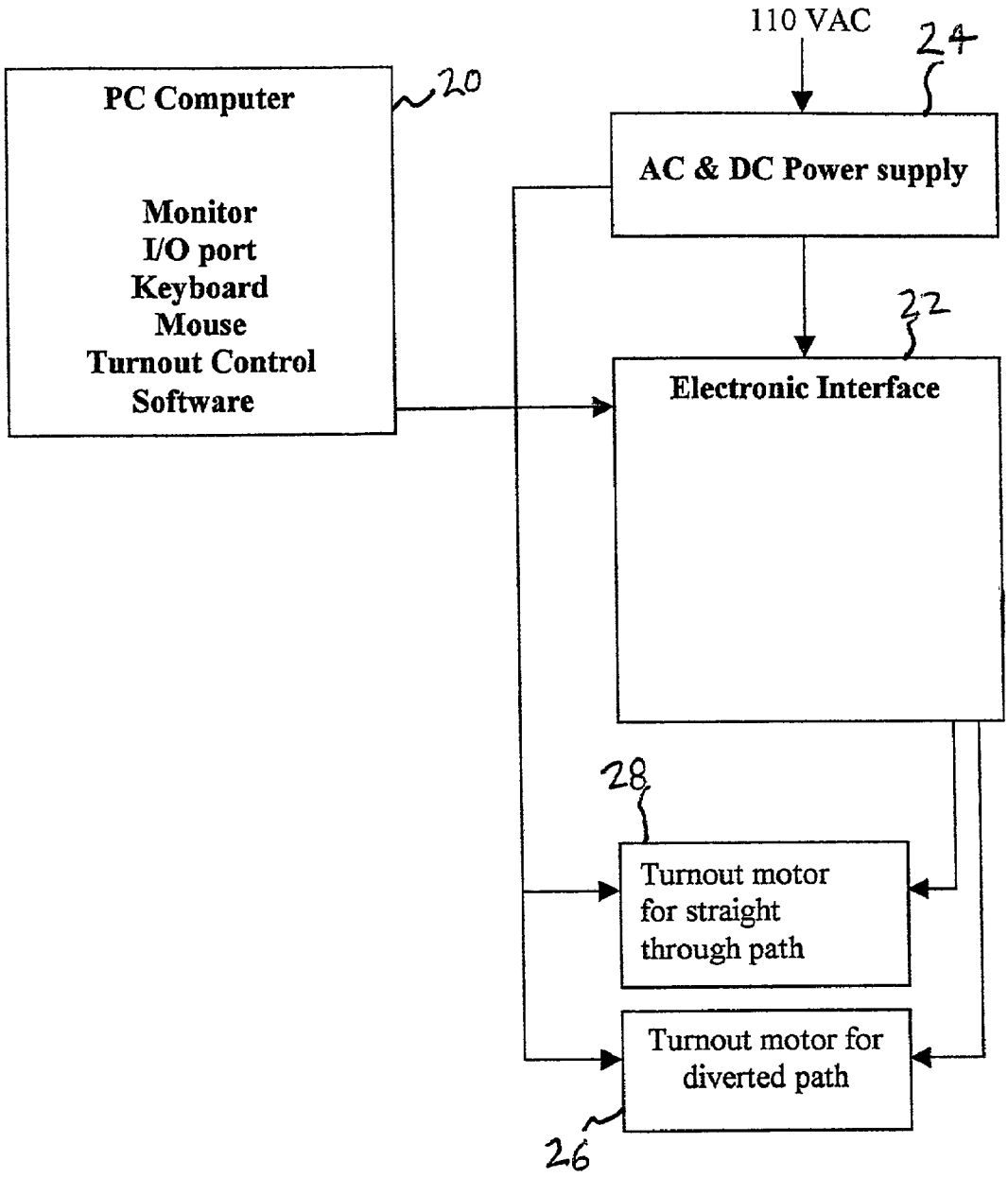
FIG. 2 is a general block diagram of model railroad control systems according to exemplary embodiments of the present invention.

According to an exemplary embodiment of the present invention, a personal computer is used as a controlling device from which a hobbyist can monitor and change the layout configuration. Referring to FIG. 2, a personal computer 20 may include, for example, a monitor, at least one I/O port, a keyboard, a pointing device (e.g., mouse) and other software, including turnout control software associated with the present invention. The personal computer 20 is connected to an electronic interface 22, which translates the control signals supplied by the personal computer into control signal(s) usable to activate one (or more) of the selected turnout motor s 26 and 28. To simplify FIG. 2, only two turnout motors 26 and 28 are illustrated, e.g., associated with turnout 19 in FIG. 1. However those skilled in the art will appreciate that a typical implementation will include numerous turnout motors, or the like, under the control of computer 20 via signals from interface 22. Moreover, although solenoid-type turnout motors 26 and 28 are used to illustrate the invention in FIG. 2, those skilled in the art will appreciate that any type of electromechanical transducer, e.g., the rotational motor described in the Background, which can translate an electrical signal into a physical change in the turnout configuration may be used therein.

According to this exemplary embodiment, the system is powered by an AC/DC power supply 24. For example, power supply 24 can provide low voltage AC as well as a 5V DC power. The 5V DC can be used to power the electronic interface 22, while the low voltage AC is used by the turnout motors 26 and 28. A rotational motor, if used in place of the solenoid-type motors 26 and 28 typically require different voltages and, therefore, power supply 24 would be modified to provide the requisite voltage thereto.

Having generally described exemplary embodiments of the present invention, a more specific, detailed example regarding the signaling interaction between computer 20, interface 22 and motors 26 and 28 will now be provided to enhance understanding of the present invention. In this example, when the user provides a change in the layout, e.g., by changing the graphical user interface displayed on computer 20, this change is translated into a command word to be transmitted to the electronic interface 22. The electronic interface 22 then receives, for example, an 8 bit command word via an I/O port cable connecting the electronic interface 22 with the computer 20. According to this exemplary embodiment, the 8 bit data word includes: a three 3 bit address field, a four bit group field and one data bit. The three bit address field and four bit group field permit 128 solenoid-type turnouts to be addressed or 64 rotational motor type turnouts to be addressed in each command signal as will be more apparent in the discussion of the detailed circuit schematics of FIGS. 4 and 5, below. A data strobe stores the data value (1 or 0, e.g., associated with the "straight" or "turned" path through a turnout) in addressable latches (seen in FIGS. 4 and 5). Those skilled in the art will appreciate that this format for the command word is purely illustrative and that other formats, e.g., expanding the number of addressable motors, for the command signaling are intended to be encompassed by the present invention.

Figure 3A:
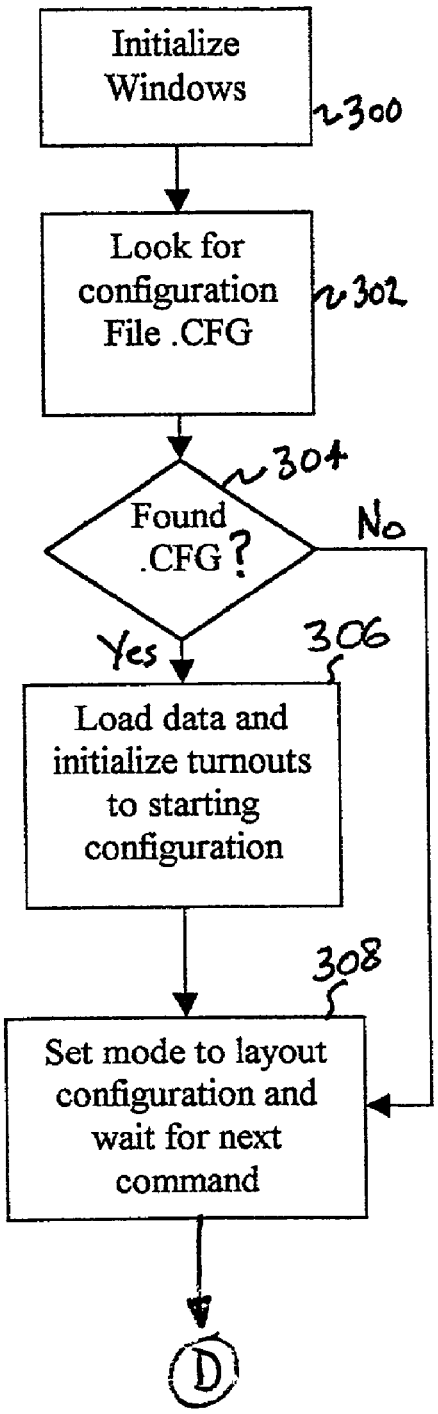
FIGS. 3(*a*)–3(*d*) are flow diagrams which are used to describe methods and control programs according to the present invention.
Figure 3B:
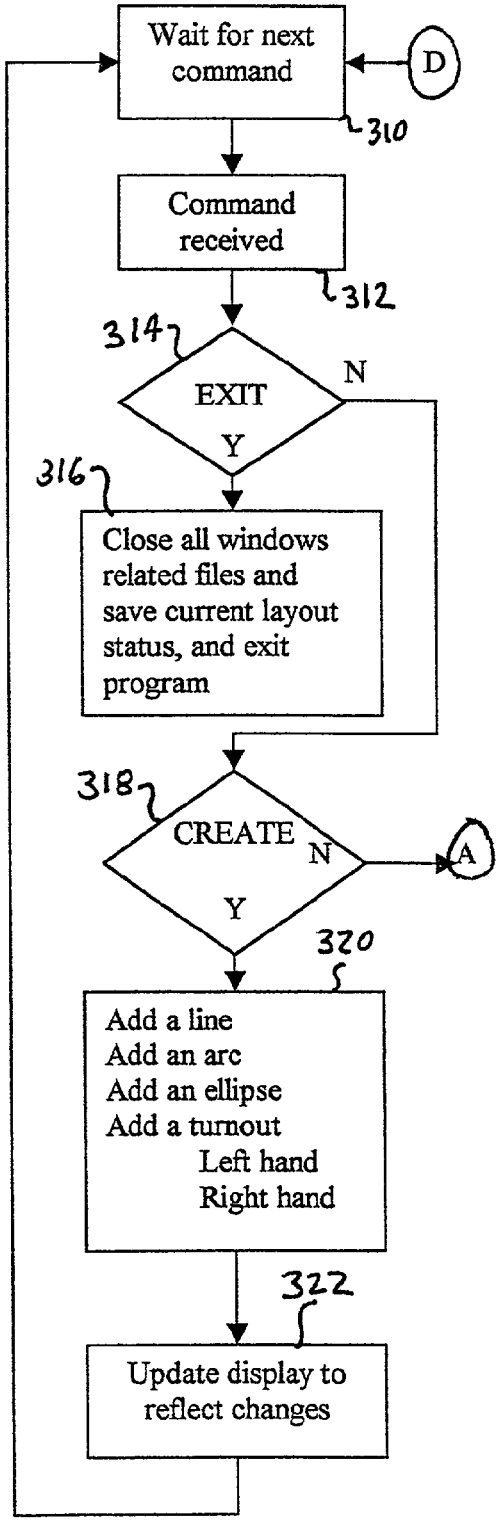
Figure 3C:
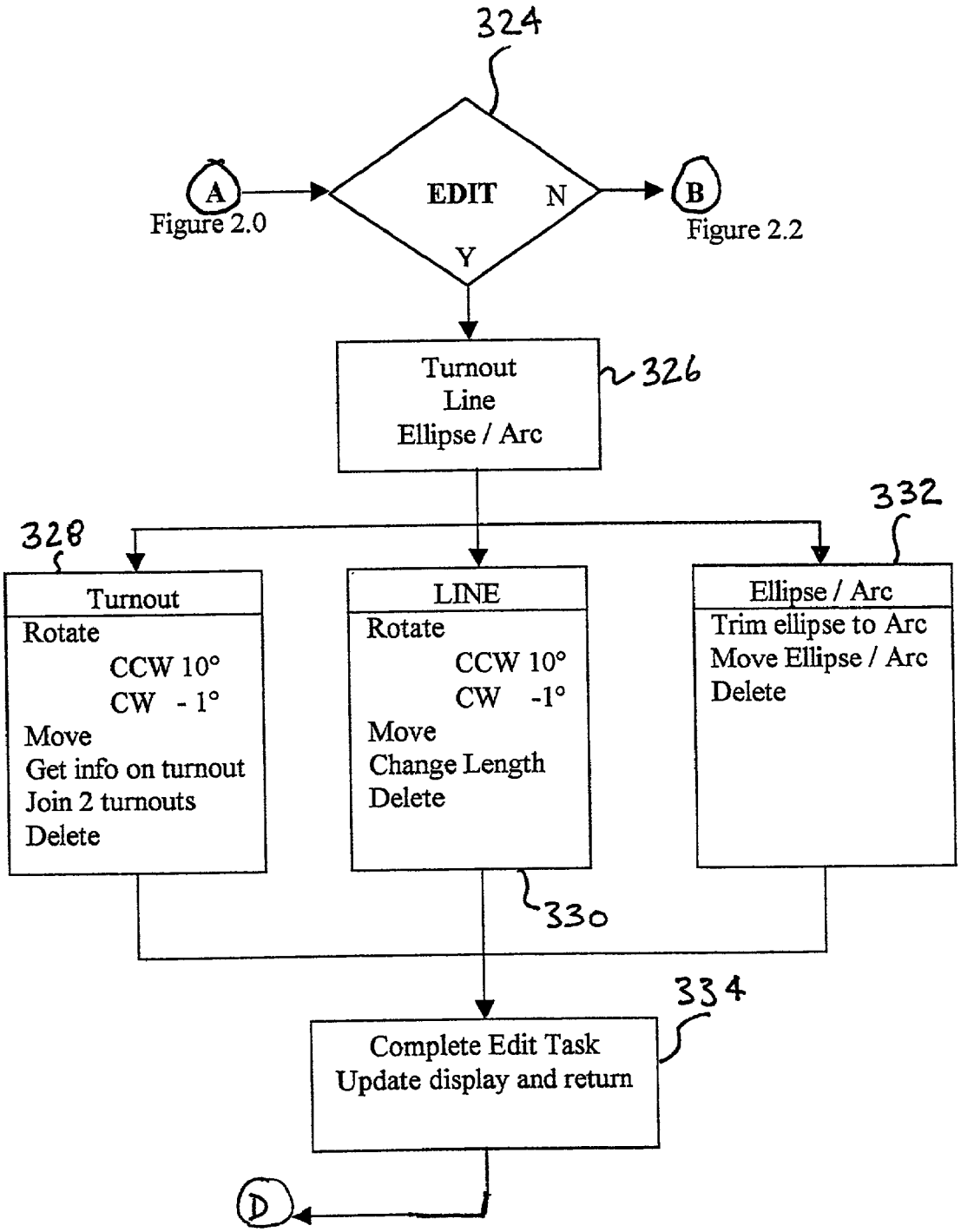
Figure 3:
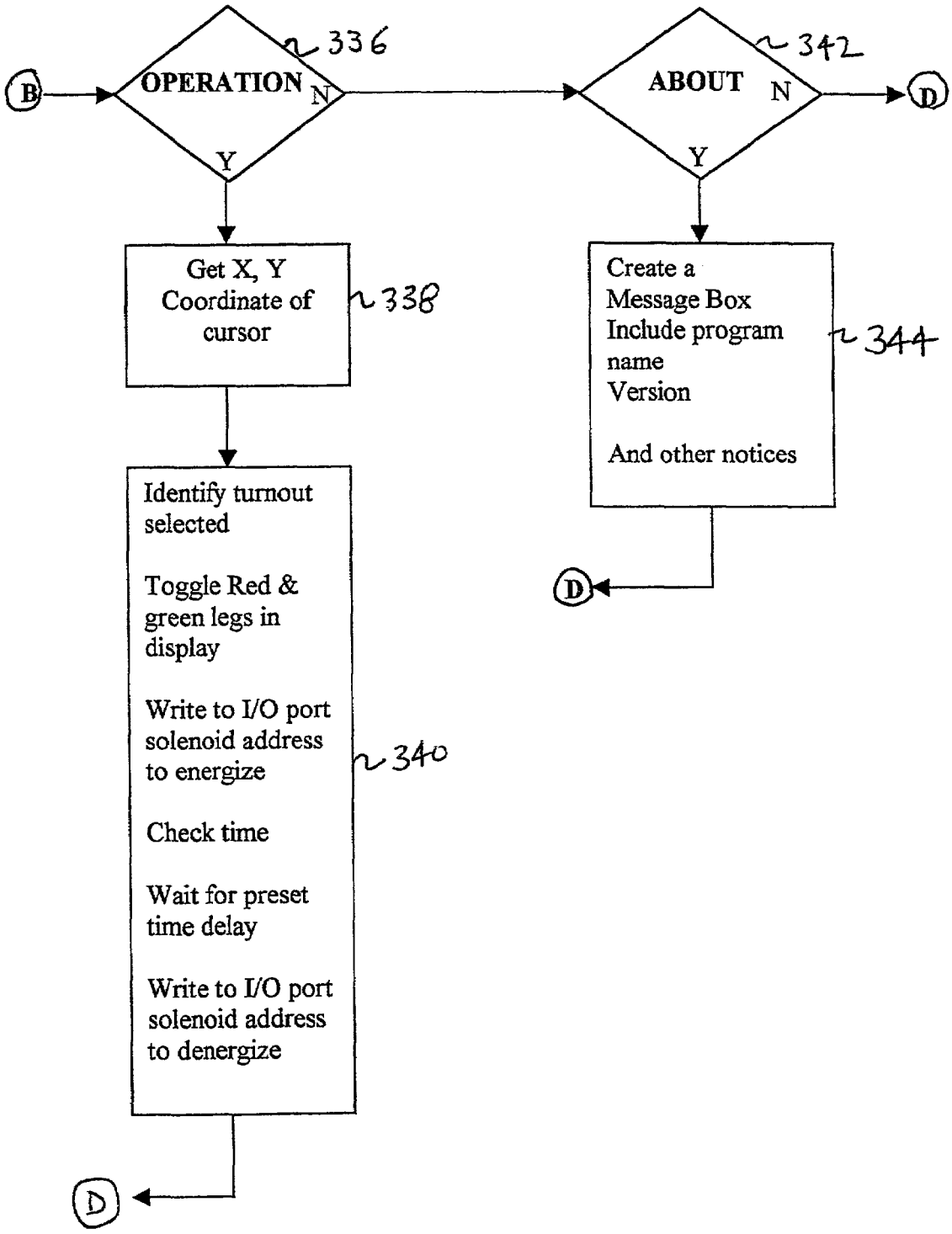

Referring now to FIG. 3(*a*), exemplary track turnout control software according to the present invention will now be described. This control software can reside on any suitable, computer-readable medium, e.g., a floppy disk, hard drive or CD, associated with computer 20. After the operating system, e.g., WINDOWS 3.1, is up and running and the user activates the control software, step 300, it will first search a predetermined directory, e.g., the directory in which the control software resides, for a configuration data file at step 302. If found (step 304) the control software will load the configuration data into the data structures used in the control software to monitor and control the turnouts within the layout at step 306. The control software then enters places the program in the operation mode and waits for user input at step 308. It on the other hand, there is no configuration data file stored in computer 20 or the associated computer-readable medium, then the control software directly enters the operation mode at step 308 without any initializing of the data structure values. One significant feature of GUIs according to the present invention is their ability to display a representation of the track layout which permits the user to easily identify the current configuration of the track. For example, the display presented on the computer monitor can mimic the model railroad layout depicting each track turnout with a red or green path. The green path depicts the selected path through the turnout while the red path is the deselected path. With all turnouts displayed simultaneously the condition of the layout relative to train movement can be seen at once by following the green paths.

Turning now to FIG. 3(*b*), the operation mode for control software according to an exemplary embodiment of the present invention will now be described. According to this exemplary embodiment, the user has several selectable options while in the operation mode, specifically EXIT, CREATE, EDIT, OPERATE and ABOUT. These selectable options can be displayed, e.g., on a graphical user interface (GUI) generated by the control software on the display of computer 20 using a menu format. Other GUI approaches are also possible for presenting the functionality described herein, e.g., voice activation or icon representations.

The GUI awaits an input from the user at block 310. Once a command is received at block 312, the control software identifies which command has been received and then processes that command accordingly. For example, if the user enters the EXIT command (step 314), then the control software will close all related files, save the current layout status and exit terminate at step 316. By saving the current layout status, the software and hardware according to the present invention avoids the situation wherein trains may be left sitting over turnouts in the layout, potentially causing derailments if the correct turnout positions are not restored when the control software is reinitialized.

If the user's input command is CREATE, step 318, the control software will permit the user to perform, for example, any of the actions listed in block 320. Specifically, according to this exemplary embodiment, the CREATE subprocess allows for adding straight lines, arcs, ellipses and turnouts, (left and right hand) to the facsimile of the track layout stored in the configuration data, to reflect changes made to the physical track layout. The display and data structures are then updated to reflect any created elements at step 322.

If the user selects the EDIT command from the GUI (step 324 in FIG. 3(*c*)), then a submenu or other GUI element is displayed at step 326 to provide the user with options relating to editing functions. For example, selection of the EDIT command can cause a popup menu requesting the user to identify the graphic type to be edited. In this exemplary embodiment, these graphic types include, turnout, line, and ellipse/arc, i.e., different track piece shapes. The modifications available for each type, according to this exemplary embodiment, are listed in the process blocks 328, 330 and 332. For example, a user can rotate a turnout using, e.g., the mouse in conjunction with the GUI. In this exemplary embodiment, a "left click" of the mouse will result in a 10 degree counter clockwise (CCW) rotation of a selected turnout. Similarly, a −1 degree clockwise (CW) rotation of the selected turnout can be implemented by a "right click" of the mouse. The turnout can also be moved within, or deleted from, the graphical depiction of the layout shown on the computer 20's display. The "Get info" option in block 328 provides the user with the assigned address for a particular turnout. This address is assigned to the turnout when it is first created in step 320 and may be retrieved in this portion of the GUI to provide the user with the address needed to wire the turnout properly into the interface 22, as described below. The "Join two turnouts" option in the EDIT menu will identify to the control software two turnouts that should be controlled together. Those skilled in the art will appreciate that this provides so-called crossover functionality and permits the two joined turnouts to be selectively configured with one mouse click. Once edits are completed, the flow proceeds to block 334 wherein the display is updated, new configuration data is stored and the flow returns to the awaiting input state 310

Turning now to FIG. 3(*d*), the user can also enter the OPERATIONS mode of the control software via the GUI at step 336. Here the layout has trains running under the control of the hobbyist and the control software provides an easy mechanism for changing the position of any desired turnout within the layout. This process starts with the user placing the cursor over the turnout (on the monitor) he/she wishes to alter, and pressing the left mouse button. The control software first decodes the x and y position of the cursor at step 338. Next these values are used to identify the selected turnout within the data structure previously stored by the control software as part of the CREATE and EDIT functions, so that the control software will be able to retrieve the address of that turnout at step 340. Once this is determined the red and green legs shown on the monitor are toggled. The address of the turnout motor selected is then written to the I/O port with a data value to activate the turnout motor. Since the solenoid type motors are activated with a pulse of AC, the software notes the time the activation started and, after a preset duration the address, is written again to turn the motor off. As soon as this has been completed, the process returns to wait for the next command. The ABOUT mode (342, 344), when selected, provides a text box on the GUI displaying the listed and any other relevant information about the control software and system.

Figure 4:
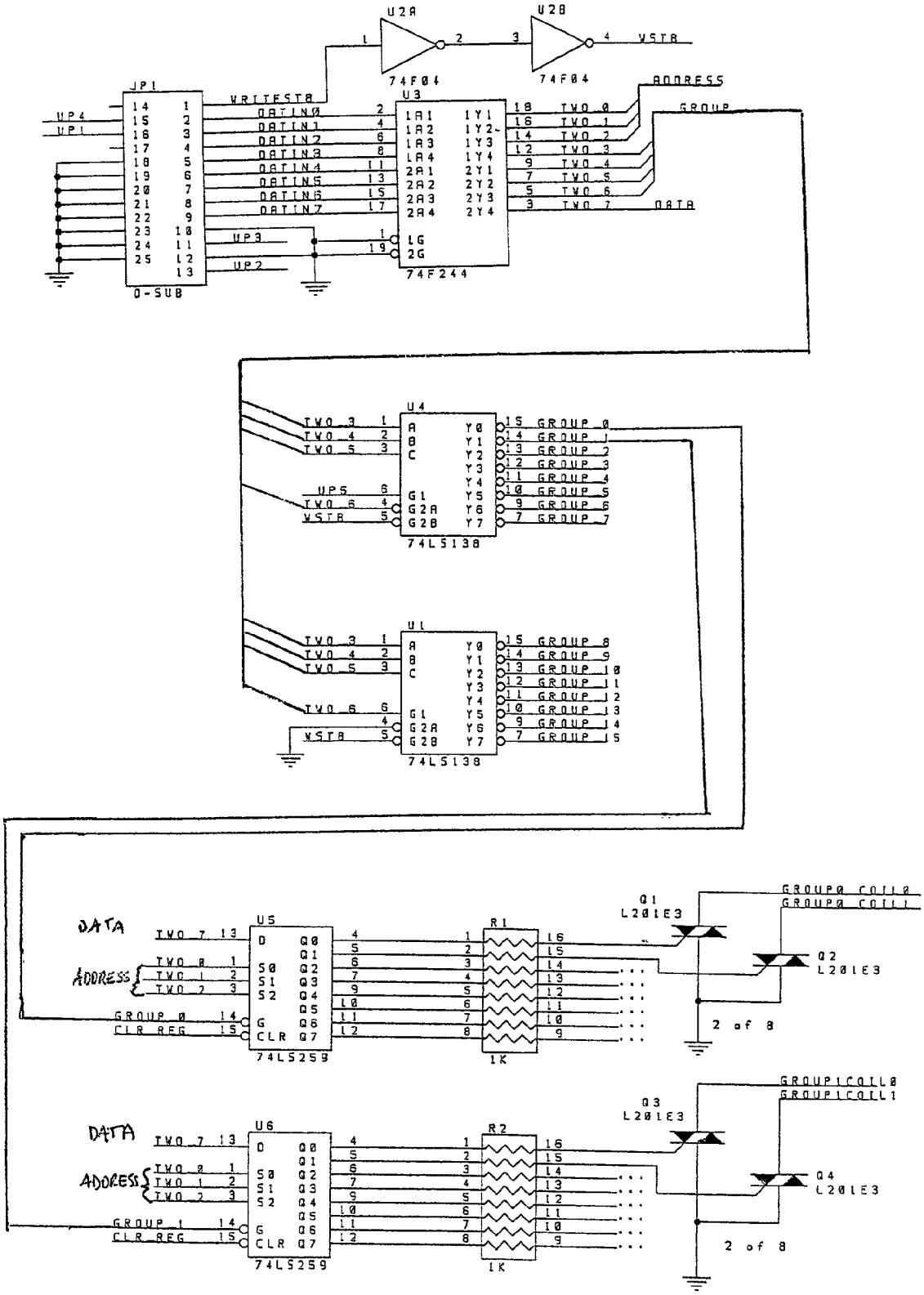
FIGS. 4 and 5 are circuit diagrams of an exemplary interface according to the present invention.

Having described control software according to the present invention, the description now turns to a detailed discussion of exemplary interfaces 22 associated with the present invention that translate the commands received from the computer 20 into the pulses used to drive motors 26 and 28. Referring first to FIG. 4, the JP1 connector is the connection to the I/O port (not shown) on the computer 20. Data is buffered by U3 and part of U2. Outputs of U3 are split for clarity. Specifically, outputs TWO_0, TWO_1, and $TWO_{13}$ 2 are address inputs to the U5 and U6 addressable registers. Two registers are shown but up to sixteen registers (in this exemplary configuration) are possible. Outputs TWO_4 through TWO_6 are the group inputs to decoders U1 and U4, which decoders enable one of sixteen group signals, i.e., Group_0 through Group_7 from U4 and Group_8 through Group_15 from U1.

Note that the write strobe (WSTB) buffered by U2 is applied to U1 and U4 causing the Group signals to be gated. The gated Group signals applied to the addressable registers U5 and U6 capture the data (TWO_7) in the one addressed register selected. The sequence of data sent by the control software in this exemplary embodiment is a 1 to activate the solenoid and a 0 to turn the motor off. The logic 1 input and the strobing GROUP signal set the register to a logic 1 level, inducing a 5 mA current through the resistor (e.g., R1 or R2) and the triac gate (e.g., Q1, Q2, Q3 or Q4). This current is sufficient to turn on the triac device, i.e., place it into its conducting state. The solenoid motor is then energized which causes the turnout to alter the path through the turnout. When the software sends the command to turn off the triac, the register receives a 0 level at the data input and the register is put in the off state, this removes the 5 mA energizing current to the triac, and it returns to the nonconducting state.

Figure 5:
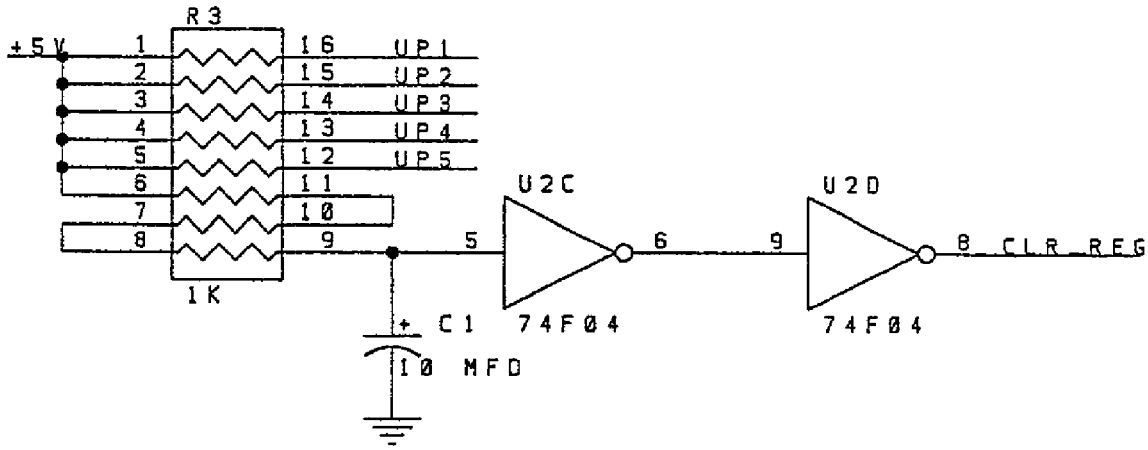

Referring now to FIG. 5, the R3 resistor pack serves to create four pull-up signals. These pull-up signals form part of the I/O protocol in the parallel printer port to which connecter JP1 is connected. The final three resistors in the pack are connected in series and applied to a 10 MFD capacitor. This RC network will cause all addressable registers to initialize to the low state, insuring that the triac devices (Q1–Q4) start up in the off state, non conducting.

Figure 6:
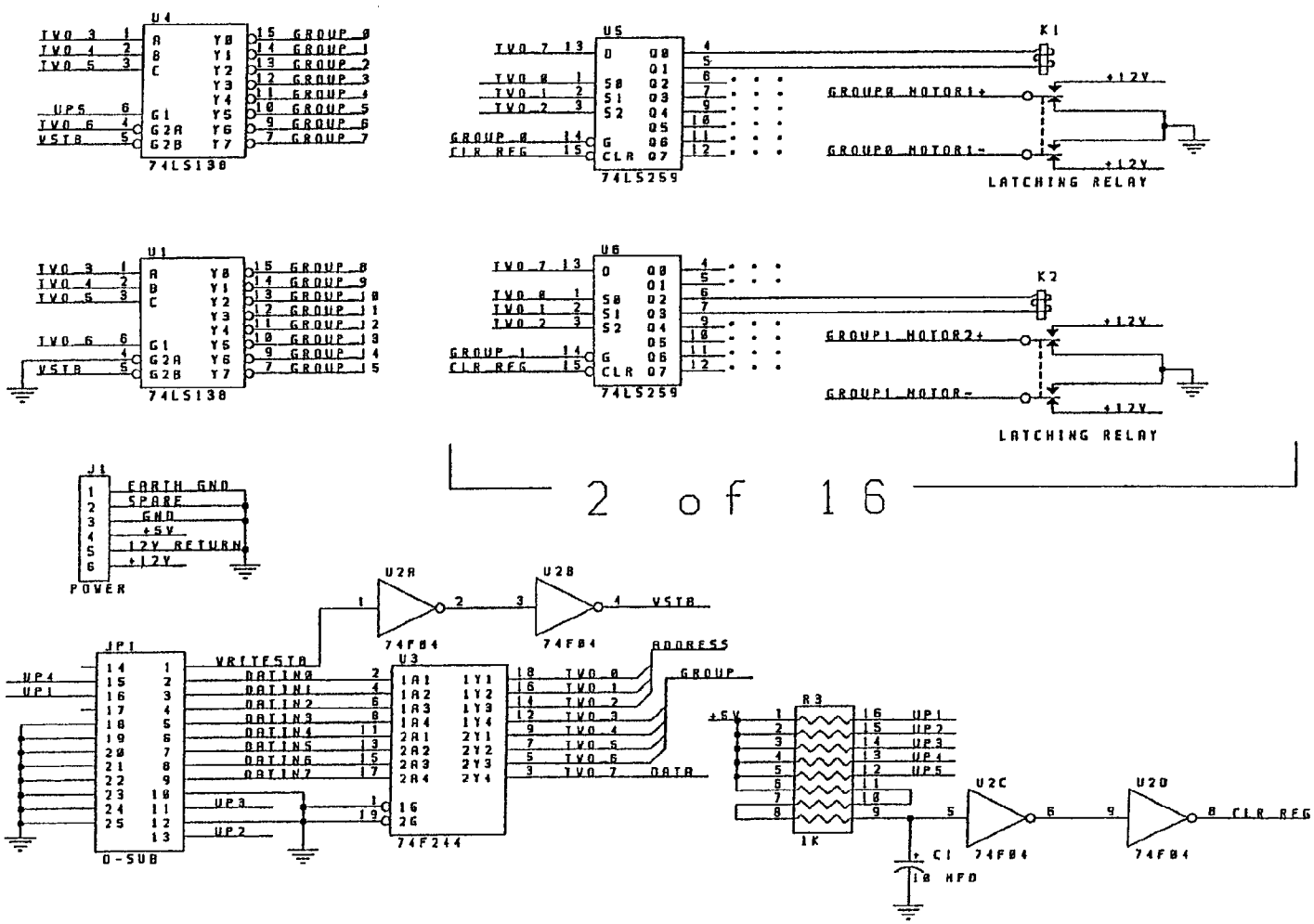
FIG. 6 is a circuit diagram of another exemplary interface according to the present invention.

Another exemplary interface is depicted in FIG. 6. This exemplary embodiment is substantially the same as that illustrated in FIGS. 4 and 5 except that the resistors and triacs are replaced with a 5-volt single coil-latching relay K1 and K2. The double pole double throw (DPDT) contacts of K1 and K2 are configured to reverse the 12-Volts DC to the motor thereby effecting control of this type of turnout motor. Note that the latching relay permits a momentary on/off excitation just as do the triacs, thereby allowing the control software to be independent of the actual electronic interface.

As mentioned in the Background section, it may also be desirable to energize the so-called "Tog" portion of the turnout. This can be accomplished by making minor modifications to the circuits illustrated in FIGS. 4–6. For example, in the interface 22 of FIG. 6, the DPDT will become a 4PDT relay, and the two track voltages will be applied to the normally open (NO), normally closed (NC) contacts. The common point will then be connected to the frog. For the exemplary interface of FIGS. 4 and 5, frog energization can be accomplished by adding a DPDT latching relay. The coil of the relay will be applied to the addressable register output, ahead of the resistor pack, e.g., between U5 and R1. The NO, NC and Commnon points will be utilized as described above.

APPENDIX

This application includes an exemplary program for performing model railroad control and display techniques as described above. The program is attached hereto on compact discs with this List of Files:

EZHEADER Size: 2 KB Created: Oct. 7, 2001
EZRESWK Size: 1 KB Created: Oct. 7, 2001
EZSWITCH Size: 36 KB Created: Oct. 8, 2001
EZXWMNU Size: 2 KB Created: Oct. 7, 2001 and is expressly incorporated here by reference.

The foregoing exemplary embodiments are intended to illustrate techniques for automating control and monitoring of turnouts in a model railroad system. However, these exemplary embodiments are intended to be purely illustrative in nature. The scope of the invention is intended to encompass these exemplary embodiments, and other embodiments, as described below in the claims.

I claim:

1. A software program stored on a computer-readable medium for monitoring and controlling a model railroad, said software program operable to perform the steps of:

displaying a representation of said model railroad layout on a display wherein a first portion of said model railroad layout is displayed using a first visual characteristic and a second portion of said model railroad layout is displayed using a second visual characteristic, wherein said first portion is selected to allow train movement thereon, and wherein said second portion is deselected to prevent train movement thereon; and editing said representation of said model railroad layout, wherein editing comprises the steps of:

identifying a graphic type associated with a type of model railroad track to be edited; and providing a list of editing functions based on the type of track to be edited, wherein said list includes a joining function if said track to be edited is a turnout section, a change length function if said track to be edited is a straight section and a trim function if said track to be edited is a curved section.

2. The software program of claim 1, wherein said first visual characteristic is green; and said second visual characteristic is red.

3. An interface unit operable to translate a command received from a computer into a motor control command for controlling at least one element within a model railroad system, said interface comprising:

a plurality of addressable units for receiving address information and data information within said command, wherein one of said plurality of addressable units that corresponds to said address information within said command translates said data information into said motor control command and outputs said motor control command, wherein said plurality of addressable units includes a set of decoders and a plurality of addressable registers, and wherein said command includes three address bits, four group bits and one data bit.

4. The interface unit of claim 3, further comprising:

a resistor bank connected to each of said plurality of addressable registers.

5. The interface unit of claim 4, further comprising:

a triac connected to each of said resistors in said resistor bank.

6. The interface unit of claim 3, further comprising:

a coil latching relay connected to each of said plurality of addressable registers.

7. A model railroad system comprising:

a graphical user interface displaying a representation of said model railroad system on a display, wherein a first portion of said model railroad layout is displayed using a first visual characteristic and a second portion of said model railroad layout is displayed using a second visual characteristic, wherein said first portion is selected to allow train movement thereon, and wherein said second portion is deselected to prevent train movement thereon;

said graphical user interface including an editing function that selectively permits a user to, rotate, move, delete and join a track portion based on a type of track portion which is selected; and an interface unit controlled by said graphical user interface to translate a command received from a computer into a motor control command for controlling at least one element within a model railroad system, said interface unit including:

a plurality of addressable units for receiving address information and data information within said command, wherein one of said plurality of addressable units that corresponds to said address information within said command translates said data information into said motor control command and outputs said motor control command, wherein said plurality of addressable units includes a set of decoders and a plurality of addressable registers, and wherein said command includes three address bits, four group bits and one data bit.

* * * * *